United States Patent [19]

Van Paesschen et al.

[11] 4,001,023

[45] Jan. 4, 1977

[54] ADHESION OF HYDROPHILIC LAYERS ON POLYESTER FILM

[75] Inventors: August Jean Van Paesschen, Antwerp; Lucien Janbaptist Van Gossum, Kontich; Jan Jozef Priem, Mortsel, all of Belgium

[73] Assignee: AGFA-Gevaert N.V., Mortsel, Belgium

[22] Filed: June 3, 1975

[21] Appl. No.: 583,209

Related U.S. Application Data

[62] Division of Ser. No. 363,390, May 24, 1973, Pat. No. 3,911,172.

[30] Foreign Application Priority Data

May 26, 1973 United Kingdom ..... 25069/73

[52] U.S. Cl. ..... 96/87 A; 96/87 R

[51] Int. Cl.[2] ..... G03C 1/78

[58] Field of Search ..... 427/171, 172, 173; 96/87 R, 87 A

[56] References Cited

UNITED STATES PATENTS

| | | | |
|---|---|---|---|
| 3,432,591 | 3/1969 | Heffefinger | 117/7 |
| 3,600,208 | 8/1971 | Abbott et al. | 96/87 R |
| 3,674,531 | 7/1972 | Shephard et al. | 96/87 R |
| 3,711,284 | 1/1973 | Van Paesschen et al. | 96/87 R |
| 3,751,280 | 8/1973 | Nervrkar et al. | 96/87 R |
| 3,756,828 | 9/1973 | Yoneyama et al. | 96/87 R |
| 3,786,002 | 1/1974 | Van Paesschen et al. | 96/87 A |
| 3,861,924 | 1/1975 | Mackey et al. | 96/87 A |

*Primary Examiner*—Jack P. Brammer
*Attorney, Agent, or Firm*—William J. Daniel

[57] ABSTRACT

The adhesion of hydrophilic layers on a dimensionally stable polyester film support is improved by applying after longitudinal stretching of the polyester film a single adhesive layer thereon. The thus covered polyester film is stretched in transverse direction and heat-setted at 180°–220° C. The adhesive layer comprises 30 to 80 % by weight of a chlorine-containing copolymer, 5 to 30 % by weight of gelatin, 5 to 40 % by weight of a plasticizer for the gelatin and 0 to 30 % by weight of a metal-complexing antistatic agent.

The polyester film may be a film of polyethylene terephthalate and the hydrophilic layer applied to the single adhesive layer may be a light-sensitive gelatin silver halide emulsion layer.

1 Claim, No Drawings

ADHESION OF HYDROPHILIC LAYERS ON POLYESTER FILM

This is a division of Ser. No. 363,390, filed May 24, 1973, now U.S. Pat. No. 3,911,172. This invention relates to a method for improving the adhesion of hydrophilic layers on dimensionally stable polyester film supports, especially for improving the adhesion of hydrophilic photographic layers on films of dimensionally stable polyethylene terephthalate, and to the composite films and photographic materials thus obtained.

In order to ensure a perfect adhesion of hydrophilic layers such as photographic light-sensitive emulsion layers to dimensionally stable polyester film supports, i.e. polyester films that have been biaxially stretched and heat-setted, it is known to apply several intermediate layers between the support and the light-sensitive emulsion layer. In most cases two intermediate layers are needed. A first one, the adhesive layer, shows a good adhesion to the polyester film and at the same time possesses good attaching properties in respect of the second layer, the subbing layer, which usually is formed to a great extent of a hydrophilic colloid such as gelatin.

It is known that the adhesion of the adhesive layer to the polyester film support can be promoted by different expedients, which can be used separatedly or in combination:

the use of chlorine-containing copolymers as binding agents for the adhesive layer;

the application of the adhesive layer before the stretching and heat-setting of the polyester film support, the latter occurring at a temperature of about 200° C;

the addition to the coating solution of compounds, generally organic solvents, which attack the polyester film surface superficially.

Although such an adhesive layer attaches itself very tenaciously to a dimensionally stable polyester film support, a supplemental subbing layer is still needed. Indeed, the adhesion of a photographic gelatin-containing layer directly to the hydrophobic adhesive layer leaves much to be desired. This confirms the general rule that a good adhesion of a gelatin layer to a hydrophobic film surface can only be obtained when the surface of the hydrophobic film has been covered with a subbing layer that contains a sufficient amount of gelatin.

It is the object of the present invention to provide a single adhesive layer combining the properties of the usual two-layer subbing combination. In this single layer chlorine-containing copolymers are present as binder material so that a perfect adhesion on the polyester film support is obtained. Moreover, the single adhesive layer contains a sufficient amount of gelatin, so that photographic emulsion layers containing gelatin will also readily adhere to the adhesive layer.

As indicated above, in all circumstances the adhesion of the adhesive layer to the polyester film support can be improved by heating the support and the adhesive layer together at a temperature of about 200° C. In practice this can only be done when the adhesive layer is applied after longitudinal stretching of the polyester film. The thus coated polyester film is stretched then to the desired extent in transverse direction and heat-setting is effected, while keeping the film under tension, at a temperature of about 200° C.

It is also known that a polymer or a product of low molecular weight can only be stretched when the temperature during stretching is higher than the softening point of the polymer or product of low molecular weight. Stretching of polyester film normally occurs at about 80° C. Since gelatin does not have a measurable softening point, it is impossible to stretch a dry layer of gelatin at this temperature of 80° C. When a layer solely consisting of a mixture of gelatin and of a chlorine-containing copolymer is stretched, hazy layers are formed always. This can only be due to the fact that the miscibility of gelatin and of the chlorine-containing polymer is not sufficient to make sure that the presence of the stretchable polymer will favourably influence the stretchability of gelatin.

It is an object of the invention to provide hydrophilic layers in general and photographic gelatin-containing layers in particular that perfectly adhere to a dimensionally stable polyester film by the use of a single adhesive layer comprising a mixture of gelatin and of a chlorine-containing copolymer.

It is another object of the invention to improve the adhesion of the adhesive layer to the polyester film support by heating both at 180°–220° C. A further object is the incorporation of additives into the adhesive layer coating composition, so that the polyester film support carrying the adhesive layer can be stretched to a sufficient degree and heat-setted at 180°–220° C so as to obtain a dimensionally stable polyester film, the adhesive layer remaining completely clear during stretching and heat-setting.

According to the invention a process is provided for improving the adhesion of hydrophilic layers to a dimensionally stable polyester film support, which process comprises applying, after longitudinal stretching of the polyester film support, a single adhesive layer thereto, stretching the thus covered polyester film support in transverse direction and heat-setting it at 180°–220° C, said adhesive layer comprising 30 to 80% by weight of a chlorine-containing copolymer, 5 to 30% by weight of gelatin, 5 to 40% by weight of a plasticizer for said gelatin as hereinafter defined, and 0 to 30% by weight of a metal complexing antistatic agent.

By plasticizers for gelatin according to the invention compounds are understood that are soluble or dispersible in water and photographically inert and that have the property of making layers formed from mixtures of gelatin and chlorine-containing polymers stretchable, these layers after having been stretched and heated at relatively high temperatures remaining completely transparent. The action of these so-called plasticizers is not only based on the known effects shown by external plasticizers, as described i.a. in the book "Plasticization and Plasticizer Processes", Advances in Chemistry, Series 48 — American Chemical Society, Washington, D.C. — 1965. Probably this action results also in an improvement of the miscibility between gelatin and chlorine-containing copolymer, so that the chlorine-containing copolymer in fact acts as a real external plasticizer for gelatin.

Suitable plasticizers are aliphatic polyhydroxy compounds such as glycerol, tri(β-hydroxyethyl)glycerol, 1,1,1-tri(hydroxy-methyl)propane, 2-nitro-2-ethyl-1,3-propanediol, 1,3-dichloro-2-propanol, 1,2,4-butanetriol, 3-hydroxymethyl-2,4-dihydroxypentane, 1,2,6-hexanetriol, 2-hydroxymethyl-4-hydroxy-amyl alcohol, glycerol-aldehyde, and mannitol.

Equally suitable compounds ares caprolactam and N,N'-dimethylurea. Other suitable plasticizers are aliphatic carboxylic or sulphonic acids such as glutaric acid, adipic acid, azelaic acid, sebacic acid mono- and dichloro-acetic acid, 1,2,3-propene tricarboxylic acid, acrylic acid, methacrylic acid, maleic acid, fumaric acid, itaconic acid, and 2-sulpho-ethyl methacrylate; further aromatic acids such as phthalic acid, o-sulphobenzoic acid, o-nitrobenzoic acid, o-aminobenzoic acid, p-hydroxybenzoic acid, and salicyclic acid.

The chlorine-containing copolymers of the adhesive layer are copolymers comprising 70 to 95% by weight of vinyl chloride and/or vinylidene chloride, 0.5 to 10% by weight of a hydrophilic monomer, and 0.5 to 25% by weight of at least one other copolymerizable monomer.

As copolymerizable monomers may be used esters of acrylic or methacrylic acid such as methyl, ethyl, butyl, hydroxyethyl, hydroxypropyl, glycidyl and cyanoethyl acrylate or methacrylate; further vinyl esters such as vinyl acetate and the vinyl ester of versatic acid, which is sold by Shell Chemical Co., under the trade name VEOVA 10 and is a branched chain vinyl carboxylic acid ester having a molecular weight of 198 and corresponding to the formula:

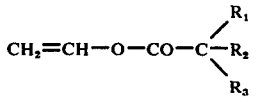

wherein $R_1$, $R_2$, and $R_3$ are alkyl groups having together from 7 to 9 carbon atoms, and wherein only one of $R_1$, $R_2$, and $R_3$ is a methyl group.

Other suitable copolymerizable monomers are acrylonitrile, acrolein and vinyl sulphofluoride.

The hydrophilic monomer may be taken from acrylic acid, methacrylic acid, crotonic acid, maleic acid, fumaric acid, itaconic acid, the amides of acrylic and methacrylic acid, mono-alkyl esters of maleic acid, and vinyl pyrrolidone.

The chlorine-containing copolymer is added in latex form to the coating composition containing gelatin. This latex is obtained by the emulsion polymerization of the different comonomers according to known emulsion polymerization techniques. The so-called primary dispersion directly formed upon emulsion polymerization may be used as such, or after adaptation of its concentration. Greatly varying concentration can be used depending on the final concentration and viscosity needed in the coating composition.

Suitable metal complexing antistatic agents are sulphosalicylic acid, 2,5-disulphohydrochinon, the sodium salt of ethylene diamine tetra-acetic acid, ethanolaminodiacetic acid, the sodium salt of N(o-hydroxybenzyl)-aminodiacetic acid, the monosodium salt of vanadic acid, 3,5-disulphopyrocatechin, phosphono-acetic acid, ethylene-1,2-diphosphonic acid, butylene-1,4-diphosphonic acid, and ascorbic acid.

To the coating composition of the adhesive layer may be added the known coating aids such as dispersing agents, spreading agents, antiseptic agents for the gelatin and thickening agents, which in general are highly viscous water-soluble polymers having as sole object to adapt the viscosity of the coating composition to the desired degree. A survey of the thickening of latices and of the thickening agents that may be used has been given by Houben-Weyl in "Methoden der organischen Chemie," Makromolekulare Stoffe, Vol, 14/1, pages 519 and 536, Georg Thieme Verlag, Stuttgart (1961).

The chlorine-containing copolymer is added in the form of a primary dispersion and in the proportions indicated above to the aqueous gelatin solution, whereafter the plasticizer and possibly the antistatic agent are dissolved in water and mixed therewith. The viscosity of the coating composition thus formed is adapted as desired and known coating aids are added to the composition. Finally the coating composition is applied in known manner to a polyester film that has been stretched 3 to 5 times in but one direction, preferably longitudinally. After drying of the layer, the polyester film is stretched 3 to 5 times in a direction perpendicular to the first stretching direction, preferably transversally.

The coating composition for the adhesive layer is applied in such a ratio that after the second stretching operation a layer having a thickness between 0.10 to 2 micron is obtained.

After the dimensional orientation of the polyester film by stretching in two perpendicular directions, the polyester film carrying the adhesive layer is conducted through a heat-setting zone, where it is heated at a temperature between 180° and 220° C while keeping the film under tension in both directions. Hereby a dimensionally stable, completely clear polyester film is formed. Hydrophilic layers, such as gelatin-containing silver halide emulsion layers can be coated directly on the adhesive layer and will tenaciously adhere to this layer. The adhesion of the hydrophilic layer to the polyester film in dry as well as in wet state during the treatment of the photographic material in the different photographic processing baths is excellent.

The examples hereinafter are especially directed to the use of polyethylene terephthalate film as support for the adhesive layer and the hydrophilic layer or layers. The adhesive layer can, however, be applied to other polyester films, e.g. polyesters resulting from the polycondensation of glycol, or mixtures of glycols with terephthalic acid or mixtures of terephthalic acid with minor amounts of other dicarboxylic acids such as isophthalic acid, diphenic acid, and sebacic acid.

The invention is illustrated by the following Examples.

EXAMPLE 1

A substantially amorphous polyethylene terephalate film having a thickness of approximately 2.2 mm was formed by extrusion of molten polyethylene terephthalate at a temperature of about 280° C on a quench drum and was chilled to a temperature of about 75° C and then stretched in the longitudinal direction over a differential speed roll stretching device to 3.5 times its initial dimension at a temperature of 84° C.

Upon the thus stretched film a layer was applied at a ratio of 70 sq.m/litre from the following coating composition:

| | |
|---|---|
| latex | 335 ml |
| 1,1,1-tri(hydroxymethyl)propane | 12 g |
| thickening agent | 14.25 ml |
| sodium salt of sulphosalicylic acid | 10 g |
| gelatin | 5 g |
| ULTRAVON W (10 % aqueous solution) | 5 ml |

-continued

| | |
|---|---|
| water | 633 ml |

The pH of the coating composition was adjusted to 8.2 with ammonia.

The latex used has a concentration of 20% by weight and was formed by the emulsion copolymerization of vinyl chloride, vinylidene chloride, n-butyl acrylate, and itaconic acid (63:30:5:2% by weight) such as described in United Kingdom patent specification No. 1,234,755 filed Sept. 28, 1967 by Gevaert-Agfa N.V.

The thickening agent was the copolymer of ethyl acrylate and methacrylic acid (80:20% by weight). It was added in the form of an aqueous dispersion having a concentration of 20% by weight.

ULTRAVON W is the trade-name of CIBA A.G., Switzerland, for a dispersing agent consisting of the disodium salt of heptadecyl-benzimidazole disulphonic acid.

After drying of the coating the film was stretched to 3.5 times in the transverse direction at a temperature of about 87° C in a tenter frame. The final thickness of the film was about 0.180 mm.

The film was then conducted into an extension of the tender frame, where it was heat-setted while kept under tension at a temperature of 200° C for about 1 minute. After heat-setting the coated film was cooled and wound up in the normal manner.

The thus heat-setted film was treated with a corona discharge and was provided with a gelatin silver halide emulsion layer as used in photographic X-ray material. The layers of the photographic material thus obtained showed a very good adhesion to the polyester film support in wet as well as in dry state.

The adhesion in dry state was checked before and after the processing. The gelatin layer was scratched cross-wise by means of a sharp knife, whereafter an adhesive tape that was pressed thereon was torn off at once. The quality was approved only if but very small pieces of the photographic layer were torn off.

The adhesion in wet state was checked by scratching the material superficially and trying to rub off the gelatin layer with a finger after each step of the photographic processing (development, rinsing, fixing, rinsing). The gelatin layer should not be damaged during this rubbing.

EXAMPLE 2

The process of Example 1 was repeated with the difference that the longitudinally stretched polyester film was covered with the following coating composition at a ratio of 70 sq.m/litre:

| | |
|---|---|
| latex | 335 ml |
| 3-hydroxymethyl-2,4-dihydroxypentane | 5 ml |
| gelatin | 10 g |
| ULTRAVON W (see Example 1) | 5 ml |
| water | 640 ml |

The latex also had a concentration of 20% by weight, but this time it was obtained by emulsion polymerisation of vinylidene chloride, methyl acrylate, and itaconic acid (88:10:2% by weight).

After transverse stretching and heat-setting as described in Example 1 a gelatin silver halide emulsion layer as used in photographic X-ray material was applied to the adhesive layer.

The layers showed good adhesion to the film support in dry as well as in wet state.

EXAMPLE 3

The process of Example 1 was repeated with the difference that the adhesive layer was coated from the following coating composition:

| | |
|---|---|
| latex | 350 ml |
| gelatin | 20 g |
| 1,1,1-tri(hydroxymethyl)propane | 20 g |
| water | 610 ml |

The latex used had a concentration of 20% by weight and was obtained by emulsion polymerisation of vinyl chloride, methyl acrylate, and itaconic acid (88:10:2% by weight).

Excellent adhesion of the gelatin silver halide emulsion layer in dry as well as in wet state was obtained.

EXAMPLE 4

In Example 1 the adhesive layer was formed from the following coating composition:

| | |
|---|---|
| latex | 350 ml |
| gelatin | 30 g |
| 4-hydroxy-2-hydroxymethyl-amyl alcohol | 25 g |
| water | 595 ml |

The latex is a copolymer of vinylidene chloride, vinylchloride, methylacrylate, and itaconic acid (58:30:10:2% by weight).

Excellent adhesion of a lithographic photographic emulsion layer in dry and in wet state was obtained.

EXAMPLE 5

An amorphous polyethylene terephthalate film of 1.2 mm in thickness was formed by extrusion of molten polyethylene terephthalate at a temperature of about 280° C onto a quenching drum and then stretched 3.5 times in the longitudinal direction.

The thus stretched film was treated with a corona discharge and then coated with the following solution at a ratio of 75 sq.m/litre.

| | |
|---|---|
| latex (as in Example 1) | 175 ml |
| gelatin | 20 g |
| 1,2,4-trihydroxybutane | 35 g |
| water | 770 ml |

Excellent adhesion of a photographic X-ray emulsion layer in dry and in wet state was obtained.

EXAMPLE 6

In Example 5 the adhesive layer was formed from the following coating composition:

| | |
|---|---|
| latex (as in Example 2) | 125 ml |
| gelatin | 20 g |
| sodium salt of sulphosalicyclic acid | 10 g |
| 1,1,1-tri(hydroxymethyl)-propane | 20 g |

Excellent adhesion of the hydrophilic layer in dry and in wet state was obtained.

EXAMPLE 7

The process of Example 1 was repeated with the difference that the longitudinally stretched polyethylene terephthalate film was covered with the following coating composition at a ratio of 70 sq.m/litre:

| | |
|---|---|
| latex (as in Example 1) | 335 ml |
| gelatin | 6 g |
| sodium salt of sulphosalicyclic acid | 10 g |
| o-sulphobenzoic acid | 10 g |
| water | 640 ml |

Before the coating the composition was brought at pH 8 by the addition of ammonium hydroxide.

After transversal stretching and heat-setting a gelatin silver halide emulsion layer as used in photographic X-ray material was applied to the adhesive layer.

The layers showed excellent adhesion in dry as well as in wet state.

If in the above coating composition the o-sulphobenzoic acid was omitted, the adhesive layer after stretching of the support became completely hazy, thus making the whole totally unadapted for use as a support for photographic materials.

EXAMPLES 8 and 9

The process of Example 7 was repeated. In the coating composition, however, the o-sulphobenzoic acid had been replaced by a same amount of itaconic acid or of 2-sulphoethyl methacrylate. In both cases a photographic X-ray material was obtained, the layers of which showed excellent adhesion in dry as well as in wet state.

EXAMPLE 10

The process of Example 7 was repeated with the difference, however, that the o-sulphobenzoic acid was replaced by 15 g of glutaric acid and that the amount of water was 635 ml instead of 640 ml. Excellent adhesion of the layers in dry and wet state was obtained.

EXAMPLE 11

The process of Example 7 was repeated with the difference, that the longitudinally stretched polyethylene terephthalate film was covered with the following coating composition at a ratio of 70 sq.m/litre:

| | |
|---|---|
| latex (as in Example 1) | 420 ml |
| gelatin | 30 g |
| sodium salt of sulphosalicyclic acid | 12 g |
| adipic acid (as a 20 % aqueous solution) | 120 g |
| ULTRAVON W (10 % aqueous solution) | 6 ml |
| water | 574 ml |

A photographic X-ray material was obtained, the layers of which showed excellent adhesion in dry as well as in wet state.

We claim:

1. Photographic gelatin silver halide light-sensitive material comprising a biaxially stretched polyester film support, a single adhesive layer adhered to said polyester film after longitudinal stretching of said film and stretched integrally with said film in the transverse direction, said stretched film and layer being heat-set at 180°–220° C, and at least one light-sensitive gelatin silver halide emulsion layer, said adhesive layer comprising 30 to 80% by weight of chlorine-containing copolymer, 5 to 30% by weight of gelatin, 5 to 40% by weight of a plasticizer for said gelatin, and 8 to 30% by weight of a metal-complexing antistatic agent, said chlorine-containing copolymer comprising about 70 to 95% by weight of a vinyl chloride and/or vinylidene chloride, about 0.5 to 10% by weight of a hydrophilic monomer, and about 0.5 to 25% of at least one other copolymerizable monomer, and said antistatic agent beinga sulphosalicylic acid salt.

* * * * *

UNITED STATES PATENT AND TRADEMARK OFFICE

CERTIFICATE OF CORRECTION

PATENT NO. : 4,001,023

DATED : January 4, 1977

INVENTOR(S) : August Jean Van Paesschen et al

It is certified that error appears in the above-identified patent and that said Letters Patent are hereby corrected as shown below:

In the Heading:

Item [30] Foreign Application Priority Data,

"May 26, 1973 United Kingdom ..... 25069/73"

should read:

-- May 26, 1972 United Kingdom ..... 25069/72 --.

Signed and Sealed this

Sixth Day of December 1977

[SEAL]

*Attest:*

RUTH C. MASON
*Attesting Officer*

LUTRELLE F. PARKER
*Acting Commissioner of Patents and Trademarks*